US005573841A

United States Patent [19]

Adam et al.

[11] Patent Number: 5,573,841

[45] Date of Patent: Nov. 12, 1996

[54] HYDRAULICALLY ENTANGLED, AUTOGENOUS-BONDING, NONWOVEN COMPOSITE FABRIC

[75] Inventors: Gabriel H. Adam, Roswell; James D. Cotton, Marietta; Donald F. Durocher, Roswell; Richard M. Peterson, Marietta, all of Ga.

[73] Assignee: Kimberly-Clark Corporation, Neenah, Wis.

[21] Appl. No.: 222,771

[22] Filed: Apr. 4, 1994

[51] Int. Cl.[6] ..... D04H 1/04

[52] U.S. Cl. ..... 428/219; 28/104; 28/105; 28/103; 28/112; 28/167; 428/220; 428/253; 428/284; 428/286; 428/296; 428/297; 428/298; 428/299; 428/326; 428/903

[58] Field of Search ..... 28/104, 105, 103, 28/112, 167; 428/90, 296, 297, 298, 299, 326, 246, 219, 220, 253, 284, 903, 253, 286

[56] References Cited

U.S. PATENT DOCUMENTS

| | | | |
|---|---|---|---|
| 2,862,251 | 12/1958 | Kalwaites | 19/161 |
| 3,284,857 | 11/1966 | Hynek | 19/161 |
| 3,330,009 | 7/1967 | Hynek | 19/161 |
| 3,336,182 | 8/1967 | Bassett et al. | 161/110 |
| 3,486,168 | 12/1969 | Evans et al. | 161/169 |
| 3,493,462 | 2/1970 | Bunting et al. | 161/169 |
| 3,494,821 | 2/1970 | Evans | 161/169 |
| 3,498,874 | 3/1970 | Evans et al. | 161/109 |
| 3,560,326 | 2/1971 | Bunting et al. | 161/169 |
| 3,620,903 | 11/1971 | Bunting et al. | 161/169 |
| 3,930,086 | 12/1975 | Harmon | 428/131 |
| 4,410,579 | 10/1983 | Johns | 428/131 |
| 4,442,161 | 4/1984 | Kirayoglu et al. | 428/219 |
| 4,542,060 | 9/1985 | Yoshida et al. | 428/287 |
| 4,582,666 | 4/1986 | Kenworthy et al. | 264/557 |
| 4,755,421 | 7/1988 | Manning et al. | 428/224 |
| 4,775,579 | 10/1988 | Hagy et al. | 428/284 |
| 4,808,467 | 2/1989 | Suskind et al. | 428/284 |
| 4,879,170 | 11/1989 | Radwanski et al. | 428/233 |
| 4,931,355 | 6/1990 | Radwanski et al. | 428/283 |
| 4,939,016 | 7/1990 | Radwanski et al. | 428/152 |
| 4,950,531 | 8/1990 | Radwanski et al. | 428/284 |
| 5,054,349 | 10/1991 | Vuillaume | 83/177 |
| 5,151,320 | 9/1992 | Homonoff et al. | 428/284 |
| 5,284,703 | 2/1994 | Everhart et al. | 428/283 |

FOREIGN PATENT DOCUMENTS

| | | |
|---|---|---|
| 841938 | 5/1970 | Canada . |
| 1307104 | 9/1992 | Canada . |
| 0159630A3 | 10/1985 | European Pat. Off. . |
| 0223614A3 | 5/1987 | European Pat. Off. . |
| 0308320A3 | 3/1989 | European Pat. Off. . |
| 304825A2 | 3/1989 | European Pat. Off. . |
| 0333211A2 | 9/1989 | European Pat. Off. . |
| 0373974A2 | 6/1990 | European Pat. Off. . |
| 0380127A | 8/1990 | European Pat. Off. . |
| 472355A1 | 2/1992 | European Pat. Off. . |
| 0492554A1 | 7/1992 | European Pat. Off. . |
| 128667 | 9/1992 | European Pat. Off. . |
| 9004060 | 4/1990 | WIPO . |

*Primary Examiner*—James J. Bell
*Attorney, Agent, or Firm*—Karl V. Sidor

[57] ABSTRACT

Disclosed is a hydraulically entangled, autogenous-bonding, nonwoven composite fabric composed of a matrix of substantially continuous, thermoplastic polymer filaments and at least one substantially non-thermoplastic fibrous material integrated in the matrix so that the composite fabric is adapted to autogenously bond to itself upon application of heat. The hydraulically entangled, autogenous-bonding, nonwoven composite fabric may be suitable as infusion package material for applications such as, for example, tea bags and coffee filter pouches. Also disclosed is a method of making a hydraulically entangled, autogenous-bonding, nonwoven composite fabric.

22 Claims, 2 Drawing Sheets

HYDRAULICALLY ENTANGLED, AUTOGENOUS-BONDING, NONWOVEN COMPOSITE FABRIC

FIELD OF THE INVENTION

The present invention relates to a hydraulically entangled nonwoven composite fabric containing a continuous filament component and a fibrous component and a method for making a nonwoven composite fabric.

BACKGROUND OF THE INVENTION

In the past, heat-sealable webs for use in such applications as infusion packaging, desiccant bags, medical packaging and the like have been made utilizing wet-forming papermaking technology. These webs are typically reinforced by adding long natural or synthetic fibers to a pulp fiber furnish so the webs have adequate wet strength. Because such long fibers are difficult to handle in wet-forming systems, viscosity modifiers (e.g., guar gums and the like) are often added to improve uniformity of the resulting web. These additives also provide improved levels of wet strength.

Heat-sealability is typically provided by a second wet-formed layer containing a relatively large proportion of thermoplastic heat-seal fibers such as, for example, vinyl acetate, polyethylene or polypropylene fibers. Such conventional wet-formed webs are relatively expensive at least because of the high levels of both long fibers and heat-seal fibers as well as relative low production rates because of the difficulty in handling long fibers in a wet-forming system.

Accordingly, there is still a need for an inexpensive, high strength, nonwoven fabric which is able to be heat-sealed. There is also a need for an inexpensive heat-sealable composite fabric which is able to resist delaminating even after exposure to water, aqueous solvents, oils and the like. A need exists for an inexpensive heat-sealable composite fabric that can be used as a material for infusion packages or as a permeable component of infusion packaging. There is also a need for a practical method of making an inexpensive heat-sealable composite fabric. This need also extends to a method of making such a composite fabric which contains pulp fibers and continuous spunbonded filaments of a thermoplastic polymer. Meeting this need is important since it is both economically and environmentally desirable to substitute ordinary pulp fiber for high-quality exotic pulps and expensive heat-seal fibers and still provide an inexpensive heat-sealable composite fabric.

DEFINITIONS

The term "machine direction" as used herein refers to the direction of travel of the forming surface onto which fibers are deposited during formation of a nonwoven web.

The term "cross-machine direction" as used herein refers to the direction which is perpendicular to the machine direction defined above.

The term "pulp" as used herein refers to cellulosic fibers from natural sources such as woody and non-woody plants. Woody plants include, for example, deciduous and coniferous trees. Non-woody plants include, for example, cotton, flax, esparto grass, sisal, abaca, milkweed, straw, jute, hemp, and bagasse.

The term "average fiber length" as used herein refers to a weighted average length of fibers (e.g., pulp fibers) determined by equipment such as, for example, a Kajaani fiber analyzer model No. FS-100 available from Kajaani Oy Electronics, Kajaani, Finland. According to a standard test procedure, a sample is treated with a macerating liquid to ensure that no fiber bundles or shives are present. Each sample is disintegrated into hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k} (x_i * n_i)/n$$

where k=maximum fiber length $x_i$=fiber length $n_i$=number of fibers having length $x_i$ n=total number of fibers measured.

As used herein, the term "spunbonded filaments" refers to small diameter continuous filaments which are formed by extruding a molten thermoplastic material as filaments from a plurality of fine, usually circular, capillaries of a spinnerette with the diameter of the extruded filaments then being rapidly reduced as by, for example, eductive drawing and/or other well-known spunbonding mechanisms. The production of spun-bonded nonwoven webs is illustrated in patents such as, for example, in U.S. Pat. No. 4,340,563 to Appel et al., and U.S. Pat. No. 3,692,618 to Dorschner et al. The disclosures of these patents are hereby incorporated by reference.

As used herein, the term "thermoplastic material" refers to a high polymer that softens when exposed to heat and returns to generally its un-softened state when cooled to room temperature. Natural substances which exhibit this behavior are crude rubber and a number of waxes. Other exemplary thermoplastic materials include, without limitation, polyvinyl chlorides, some polyesters, polyamides, polyfluorocarbons, polyolefins, some polyurethanes, polystyrenes, polyvinyl alcohols, caprolactams, copolymers of ethylene and at least one vinyl monomer (e.g., poly(ethylene vinyl acetates), copolymers of ethylene and n-butyl acrylate (e.g., ethylene n-butyl acrylates), and acrylic resins.

As used herein, the term "non-thermoplastic material" refers to any material which does not fall within the definition of "thermoplastic material," above.

As used herein, the term "autogenous bonding" refers to bonding between discrete parts and/or surfaces produced independently of external additives such as adhesives, solders, solvents, mechanical fasteners and the like. Autogenous bonding between parts and/or surfaces may take place when a sufficient amount of heat is applied to one or more compatible thermoplastic materials which compose or is included in those parts and/or surfaces.

SUMMARY OF THE INVENTION

The present invention addresses the needs discussed above by providing a hydraulically entangled, autogenous-bonding, nonwoven composite fabric composed of: 1) a matrix of substantially continuous thermoplastic polymer filaments; and 2) at least one substantially non-thermoplastic fibrous material integrated in the matrix so that the composite fabric is adapted to autogenously bond to itself upon application of heat.

According to the invention, the matrix of substantially continuous thermoplastic polymer filaments can be a nonwoven web of spunbonded filaments. Desirably, the nonwoven web of spunbonded filaments may be a nonwoven web of bi-component spunbonded filaments.

The matrix-of substantially continuous thermoplastic polymer filaments may be composed of thermoplastic polymers selected from polyolefins, polyamides, polyesters, polyurethanes, A-B and A-B-A' block copolymers where A and A' are thermoplastic endblocks and B is an elastomeric midblock, copolymers of ethylene and at least one vinyl monomer, unsaturated aliphatic monocarboxylic acids, and esters of such monocarboxylic acids. If the thermoplastic polymer is a polyolefin, it may be, for example, polyethylene, polypropylene, polybutene, ethylene copolymers, propylene copolymers, butene copolymers and/or blends of the above.

The substantially non-thermoplastic fibrous material may be selected from pulp fibers, cotton linters, flax, natural fibers, synthetic fibers, and mixtures of the same. The fibrous material may have an average length of from about 0.7 to about 20 millimeters. If the fibrous material is pulp fibers, the pulp fibers may be hardwood pulp fibers, softwood pulp fibers, recycled or secondary fibers and mixtures of the same. Desirably, the fibrous material is all non-thermoplastic fibrous material. However, it is contemplated that the fibrous material could include a small amount of thermoplastic fibrous materials. For example, up to about 15 percent, by weight, of the fibrous material may be composed of thermoplastic fibrous materials.

Generally speaking, the hydraulically entangled, autogenous-bonding, nonwoven composite fabric contains from about 10 to about 90 percent, by weight, of a matrix of substantially continuous, thermoplastic polymer filaments; and from about 90 to about 10 percent, by weight, of at least one substantially non-thermoplastic fibrous material integrated in the matrix. For example, the hydraulically entangled, autogenous-bonding, nonwoven composite fabric may contain from about 25 to about 75 percent, by weight, thermoplastic polymer filaments and from about 75 to about 25 percent, by weight, fibrous material. Desirably, the hydraulically entangled, autogenous-bonding, nonwoven composite fabric may contain from about 40 to about 60 percent, by weight, thermoplastic polymer filaments and from about 60 to about 40 percent, by weight, fibrous material.

In one aspect of the invention, the hydraulically entangled, autogenous-bonding, nonwoven composite fabric may have a basis weight of from about 15 to about 300 grams per square meter. For example, the fabric may have a basis weight of from about 15 to about 150 grams per square meter. As a further example, the fabric may have a basis weight of from about 15 to about 60 grams per square meter.

According to the invention, the hydraulically entangled, autogenous-bonding, nonwoven composite fabric can be adapted to autogenously bond to itself at a bond strength greater than about 400 grams per inch of width. For example, the composite fabric may be adapted to autogenously bond to itself at a bond strength of from about 500 to about 1000 grams per inch of width.

In one aspect of the invention, at least one layer of the hydraulically entangled, autogenous-bonding, nonwoven composite fabric may be joined to at least one other layer. For example, the hydraulically entangled, autogenous-bonding, nonwoven composite fabric may be joined to other layers of the nonwoven composite fabric or other suitable layers as, for example, films, papers, woven fabrics, knit fabrics, bonded carded webs, continuous filament webs, meltblown fiber webs, and combinations thereof.

The hydraulically entangled, autogenous-bonding, nonwoven composite fabric may be treated with small amounts of materials such as, for example, binders, surfactants, cross-linking agents, de-bonding agents, fire retardants, hydrating agents and/or pigments. Alternatively and/or additionally, the present invention contemplates adding particulates such as, for example, activated charcoal, clays, starches, and superabsorbents to the nonwoven composite fabric.

The hydraulically entangled, autogenous-bonding, nonwoven composite fabric may be used as a material for infusion packages such as, for example, tea bags, coffee pouches and the like. In one embodiment, the nonwoven composite fabric may be a single-ply or multiple-ply infusion package material having a basis weight from about 15 to about 150 grams per square meter (gsm). Desirably, material utilized in infusion packages may have a basis weight between about 15 and 60 gsm. More desirably, such material will have a basis weight of from about 15 to about 50 gsm. Alternatively and/or additionally, one or more layers of the nonwoven composite fabric may be used as a packaging material for desiccants sacks, sachets and the like.

Accordingly, the present invention also encompasses a hydraulically entangled, autogenous-bonding, nonwoven infusion package material composed of: 1) from about 25 to about 75 percent, by weight, of a matrix of substantially continuous, thermoplastic polymer filaments; and 2) from about 75 to about 25 percent, by weight, of at least one substantially non-thermoplastic fibrous material integrated in the matrix, such that the infusion package material is adapted to autogenously bond to itself upon application of heat. Desirably, the hydraulically entangled, autogenous-bonding, nonwoven infusion package material may contain from about 40 to about 60 percent, by weight, thermoplastic polymer filaments and from about 60 to about 40 percent, by weight, fibrous material.

The present invention also encompasses a method of making a hydraulically entangled, autogenous-bonding, nonwoven composite fabric. The method includes the steps of: 1) superposing a layer of at least one substantially non-thermoplastic fibrous material over a matrix of substantially continuous, thermoplastic polymer filaments, 2) integrating the fibrous material into the matrix by hydraulic entangling to form a composite fabric, and 3) drying the composite fabric, wherein the composite fabric is adapted to autogenously bond to itself upon application of heat.

The layer of fibrous material may be superposed over the matrix of substantially continuous, thermoplastic polymer filaments by depositing the fibrous material onto the matrix of substantially continuous filaments utilizing dry forming and wet-forming techniques. The layer of fibrous material may also be superposed over the matrix of substantially continuous, thermoplastic polymer filaments by superposing a coherent sheet of pulp fibers on a layer of continuous filaments.

According to the invention, the coherent sheet of pulp fibers may be a re-pulpable paper sheet, a re-pulpable tissue sheet, and a batt of wood pulp fibers.

The hydraulically entangled nonwoven composite fabric may be dried utilizing compressive or non-compressive drying process. Through-air drying processes have been found to work particularly well. Other exemplary drying processes may include the use of infra-red radiation, yankee dryers, steam cans, vacuum dewatering, microwaves, and ultrasonic energy.

DETAILED DESCRIPTION OF THE INVENTION

Figure 1:
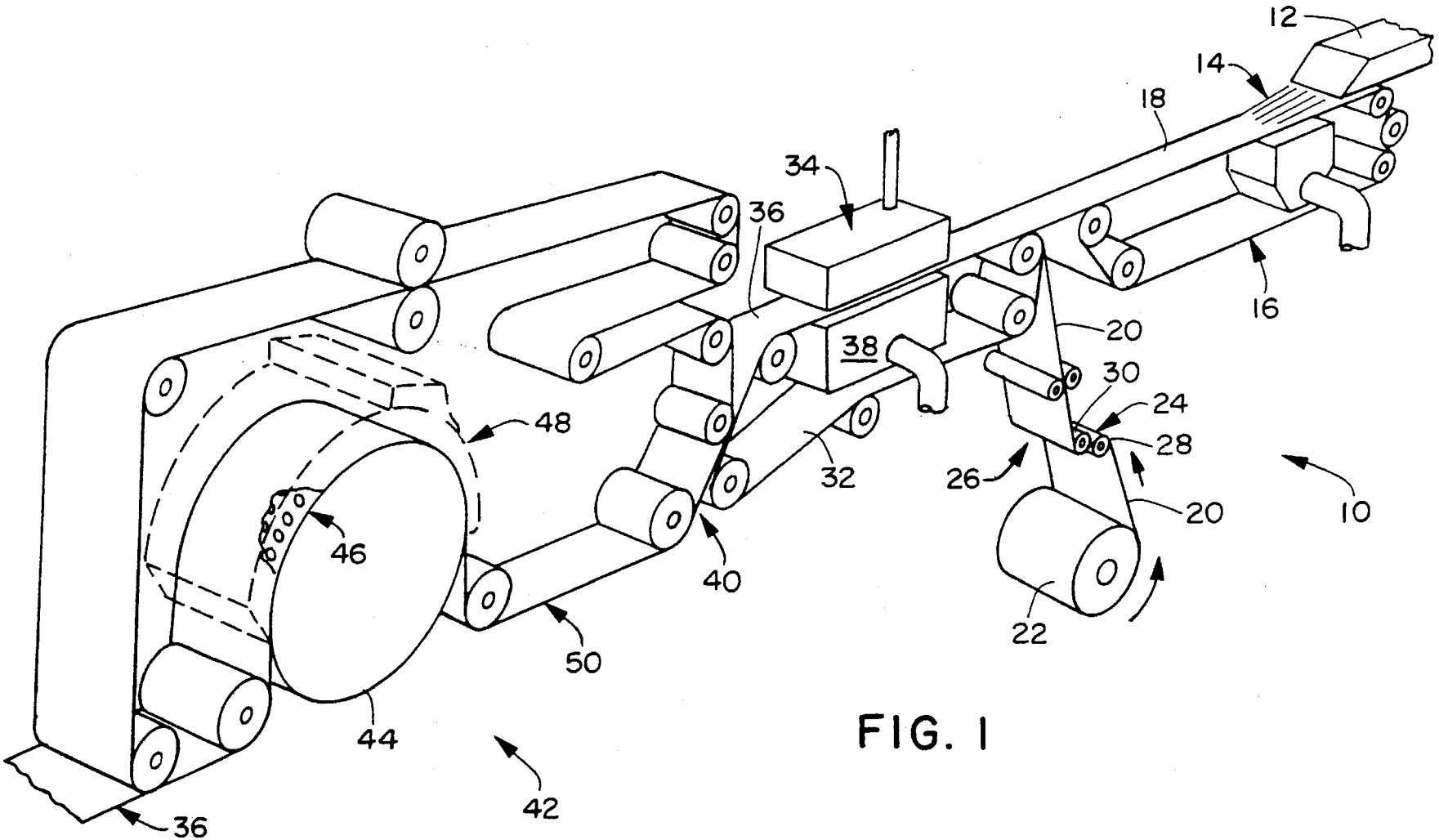
FIG. 1 is an illustration of an exemplary process for making a hydraulically entangled, autogenous-bonding, nonwoven composite fabric.

Referring to FIG. 1 of the drawings there is schematically illustrated at 10 a process for forming a hydraulically entangled, autogenous-bonding, nonwoven composite fabric. According to the present invention, a dilute suspension of substantially non-thermoplastic fibrous material is supplied by a head-box 12 and deposited via a sluice 14 in a uniform dispersion onto a forming fabric 16 of a conventional paper-making or wet-laying machine.

The suspension of fibrous may be diluted to any consistency which is typically used in conventional paper-making or wet-laying processes. For example, the suspension may contain from about 0.01 to about 1.5 percent by weight fibrous material suspended in water. Water is removed from the suspension of fibrous material to form a uniform layer of fibrous material 18.

The substantially non-thermoplastic fibrous material may be pulp fibers, cotton linters, flax, natural fibers, synthetic fibers, and mixtures of the same. Desirably, the fibrous material is all non-thermoplastic fibrous material. However, it is contemplated that small amounts (e.g., 15 percent, by weight, or less) of thermoplastic fibrous material may be added to the fibrous material. In such case, the fibrous material would have a non-thermoplastic component and a thermoplastic-component but would remain, for the purposes of the present invention, a substantially non-thermoplastic fibrous material. The fibrous material may have an average length of from about 0.7 to about 20 millimeters. If the fibrous material is pulp fibers, the pulp fibers may be hardwood pulp fibers, softwood pulp fibers, recycled or secondary fibers and mixtures of the same.

If pulp fibers are used, they may be unrefined or may be beaten to various degrees of refinement. Small amounts of wet-strength resins and/or resin binders may be added to improve strength and abrasion resistance. Useful binders and wet-strength resins include, for example, Kymene 557 H available from the Hercules Chemical Company and Parez 631 available from American Cyanamid, Inc. Cross-linking agents and/or hydrating agents may also be added to pulp fibers. Debonding agents may be added to the pulp mixture to reduce the degree of hydrogen bonding if a very open or loose nonwoven fibrous web is desired. One exemplary debonding agent is available from the Quaker Chemical Company, Conshohocken, Pa., under the trade designation Quaker 2008.

A matrix of substantially continuous thermoplastic polymer filaments (which may be in the form of, for example, a nonwoven web of spunbonded filaments) 20 is unwound from a supply roll 22 and travels in the direction indicated by the arrow associated therewith as the supply roll 22 rotates in the direction of the arrows associated therewith. The nonwoven web 20 passes through a nip 24 of a S-roll arrangement 26 formed by the stack rollers 28 and 30.

Generally speaking, the matrix of substantially continuous thermoplastic polymer filaments may be formed by known continuous filament nonwoven extrusion processes, such as, for example, known solvent spinning or melt-spinning processes, and passed directly through the nip 24 without first being stored on a supply roll. The matrix of substantially continuous thermoplastic polymer filaments is desirably a nonwoven web of continuous melt-spun filaments formed by the spunbond process. The spunbond filaments may be formed from any thermoplastic, melt-spinnable polymer, co-polymers or blends thereof. For example, the spunbond filaments may be formed from such thermoplastic polymers as polyolefins, polyamides, polyesters, polyurethanes, A-B and A-B-A' block copolymers where A and A' are thermoplastic endblocks and B is an elastomeric midblock, copolymers of ethylene and at least one vinyl monomer (such as, for example, vinyl acetates), unsaturated aliphatic monocarboxylic acids, and esters of such monocarboxylic acids. If the substantially continuous filaments are formed from a polyolefin such as, for example, polypropylene, the nonwoven web 20 may have a basis weight from about 3.5 to about 70 grams per square meter (gsm). More particularly, the nonwoven web 20 may have a basis weight from about 10 to about 35 gsm. The polymers may include additional materials such as, for example, pigments, antioxidants, flow promoters, stabilizers and the like.

Desirably, the matrix of substantially continuous thermoplastic polymer filaments is a matrix of substantially continuous thermoplastic polymer bi-component or multi-component filaments. For example, the matrix of bi-component or multi-component filaments may be a nonwoven web of bi-component or multi-component spunbonded filaments. These bi-component or multi-component filaments may have side-by-side, sheath-core or other configurations. Description of such filaments and a method for making the same may be found in, for example, U.S. patent application Ser. No. 07/933,444, filed on Aug. 21, 1992, in the name of R. D. Pike, et al., and entitled "Nonwoven Multi-component Polymeric Fabric and Method for Making the Same", the disclosure of which is hereby incorporated by reference. Exemplary nonwoven webs of bi-component or multi-component spunbonded filaments may be available from Kimberly-Clark Corporation, Roswell, Ga.

The matrix of substantially continuous thermoplastic polymer filaments may be thermally bonded (i.e., pattern bonded) before the layer of fibrous material is superposed on it. Desirably, the matrix of substantially continuous thermoplastic polymer filaments will have a total bond area of less than about 30 percent and a uniform bond density greater than about 100 bonds per square inch. For example, the matrix of substantially continuous thermoplastic polymer filaments may have a total bond area from about 2 to about 30 percent (as determined by conventional optical microscopic methods) and a bond density from about 250 to about 500 pin bonds per square inch.

Such a combination total bond area and bond density may be achieved by bonding the matrix of substantially continuous thermoplastic polymer filaments with a pin bond pattern having more than about 100 pin bonds per square inch which provides a total bond surface area less than about 30 percent when fully contacting a smooth anvil roll. Desirably, the bond pattern may have a pin bond density from about 250 to about 350 pin bonds per square inch and a total bond surface area from about 10 percent to about 25 percent when contacting a smooth anvil roll.

An exemplary bond pattern has a pin density of about 306 pins per square inch. Each pin defines a square bond surface having sides which are about 0.025 inch in length. When the pins contact a smooth anvil roller they create a total bond surface area of about 15.7 percent. Generally speaking, a high basis weight matrix of substantially continuous thermoplastic polymer filaments tends to have a bond area which approaches that value. A lower basis weight matrix tends to have a lower bond area.

Another exemplary bond pattern has a pin density of about 278 pins per square inch. Each pin defines a bond surface having 2 parallel sides about 0.035 inch long (and about 0.02 inch apart) and two opposed convex sides—each having a radius of about 0.0075 inch. When the pins contact a smooth anvil roller they create a total bond surface area of about 17.2 percent.

Yet another exemplary bond pattern has a pin density of about 103 pins per square inch. Each pin defines a square bond surface having sides which are about 0.043 inch in length. When the pins contact a smooth anvil roller they create a total bond surface area of about 16.5 percent.

Although pin bonding produced by thermal bond rolls is described above, the present invention contemplates any form of bonding which produces good tie down of the filaments with minimum overall bond area. For example, thermal bonding, through-air bonding and/or latex impregnation may be used to provide desirable filament tie down with minimum bond area. Alternatively and/or additionally, a resin, latex or adhesive may be applied to the nonwoven continuous filament web by, for example, spraying or printing, and dried to provide the desired bonding.

The layer of fibrous material 18 is then laid on the nonwoven web 20 which rests upon a foraminous entangling surface 32 of a conventional hydraulic entangling machine. It is desirable that the layer of fibrous material 18 is between the nonwoven web 20 and the hydraulic entangling manifolds 34 (i.e., on top of the nonwoven web). The layer of fibrous material 18 and nonwoven web 20 pass under one or more hydraulic entangling manifolds 34 and are treated with jets of fluid to entangle the fibrous material with the filaments of the continuous filament nonwoven web 20. The jets of fluid also drive fibrous material into and partially through the nonwoven web 20 to form the composite material 36.

Alternatively, hydraulic entangling may take place while the layer of fibrous material 18 and nonwoven web 20 are on the same foraminous screen (i.e., mesh fabric) which the wet-laying took place. The present invention also contemplates superposing a dried pulp sheet on a continuous filament nonwoven web, rehydrating the dried pulp sheet to a specified consistency and then subjecting the rehydrated pulp sheet to hydraulic entangling.

The hydraulic entangling may take place while the layer of fibrous material 18 is highly saturated with water. For example, the layer of fibrous material 18 may contain up to about 90 percent by weight water just before hydraulic entangling. Alternatively, the layer of fibrous material may be, for example, an air-laid or dry-laid layer having little or no liquid present.

Hydraulic entangling a wet-laid layer of fibrous material is desirable because the fibrous material can be embedded or integrated into and/or entwined and tangled in the matrix of substantially continuous, thermoplastic polymer filaments. If the fibrous material includes pulp fibers, hydraulic entangling a wet-laid layer is particularly desirable because it integrates the pulp fibers into the matrix of substantially continuous filaments without interfering with "paper" bonding (sometimes referred to as hydrogen bonding) since the pulp fibers are maintained in a hydrated state. Where pulp fibers are used as or included in the fibrous material, "paper" bonding appears to improve the abrasion resistance and tensile properties of the resulting hydraulically entangled, autogenous-bonding, nonwoven composite fabric.

The hydraulic entangling may be accomplished utilizing conventional hydraulic entangling equipment such as may be found in, for example, in U.S. Pat. No. 3,485,706 to Evans, the disclosure of which is hereby incorporated by reference. The hydraulic entangling of the present invention may be carried out with any appropriate working fluid such as, for example, water. The working fluid flows through a manifold which evenly distributes the fluid to a series of individual holes or orifices. These holes or orifices may be from about 0.003 to about 0.015 inch in diameter. For example, the invention may be practiced utilizing a manifold produced by Honeycomb Systems Incorporated of Biddeford, Me., containing a strip having 0.007 inch diameter orifices, 30 holes per inch, and 1 row of holes. Many other manifold configurations and combinations may be used. For example, a single manifold may be used or several manifolds may be arranged in succession.

In the hydraulic entangling process, the working fluid passes through the orifices at a pressures ranging from about 200 to about 2000 pounds per square inch gage (psig). At the upper ranges of the described pressures it is contemplated that the composite fabrics may be processed at speeds of about 1000 feet per minute (fpm). The fluid impacts the layer of fibrous material 18 and the nonwoven web 20 which are supported by a foraminous surface which may be, for example, a single plane mesh having a mesh size of from about 40×40 to about 100×100. The foraminous surface may also be a multi-ply mesh having a mesh size from about 50×50 to about 200×200. As is typical in many water jet treatment processes, vacuum slots 38 may be located directly beneath the hydro-needling manifolds or beneath the foraminous entangling surface 32 downstream of the entangling manifold so that excess water is withdrawn from the hydraulically entangled composite fabric 36.

Although the inventors should not be held to a particular theory of operation, it is believed that the columnar jets of working fluid which directly impact fibrous material laying on the matrix of substantially continuous, thermoplastic polymer filaments Work to drive those fibers into and partially through the matrix (e.g., nonwoven network) of filaments. When the fluid jets and fibrous material interact with a matrix of substantially continuous, thermoplastic polymer filaments (e.g., a nonwoven continuous filament web) having the above-described bond characteristics, the fibrous material are also entangled with filaments of the nonwoven web and with each other. If the matrix of substantially continuous filaments is too loosely bonded, the filaments are generally too mobile to adequately secure the fibrous material in the filament matrix. On the other hand, if bonding of the matrix of substantially continuous filaments is too great, the penetration and integration of the fibrous material may be poor. Moreover, too much bond area will also cause a splotchy composite fabric because the jets of fluid may splatter, splash and wash off fibrous material when they hit large non-porous bond spots. The specified levels of bonding provide a coherent matrix of substantially continuous filaments which may be formed into a composite fabric by hydraulic entangling with a layer of fibrous material on only one side and still provide a strong, useful composite fabric as well as a composite fabric having desirable dimensional stability.

In one aspect of the invention, the energy of the fluid jets that impact the layer of fibrous material and matrix of substantially continuous filaments may be adjusted so that the fibrous materials are inserted into and entangled with the matrix of substantially continuous filaments in a manner that enhances the two-sidedness of the fabric. That is, the entangling may be adjusted to produce high concentration of fibrous material on one side of the fabric and a corresponding low concentration of fibrous material on the opposite side. Such a configuration may be particularly useful to enhance autogenous bonding. Although the inventors should not be held to a particular theory of operation, it is thought that exposure of some thermoplastic, substantially continuous filaments on a surface of the composite fabric promotes autogenous bonding.

The matrix of thermoplastic, substantially continuous filaments may be entangled with the same or different layers of fibrous material on each side to create a composite fabric having an abundance of fibrous material on each surface. In that case, hydraulic entangling both sides of the composite fabric is desirable.

After the fluid jet treatment, the hydraulically entangled composite fabric 36 may be transferred to a non-compressive drying operation. A differential speed pickup roll 40 may be used to transfer the material from the hydraulic needling belt to a non-compressive drying operation. Alternatively, conventional vacuum-type pickups and transfer fabrics may be used. If desired, the composite fabric may be wet-creped before being transferred to the drying operation. Non-compressive drying of the web may be accomplished utilizing a conventional rotary drum through-air drying apparatus shown in FIG. 1 at 42. The through-dryer 42 may be an outer rotatable cylinder 44 with perforations 46 in combination with an outer hood 48 for receiving hot air blown through the perforations 46. A through-dryer belt 50 carries the composite fabric 36 over the upper portion of the through-dryer outer cylinder 44. The heated air forced through the perforations 46 in the outer cylinder 44 of the through-dryer 42 removes water from the composite fabric 36. The temperature of the air forced through the composite fabric 36 by the through-dryer 42 may range from about 200° to about 500° F. Other useful through-drying methods and apparatus may be found in, for example, U.S. Pat. Nos. 2,666,369 and 3,821,068, the contents of which are incorporated herein by reference. It is contemplated that compressive drying operations (e.g., drying operations which use pressure or combinations of pressure and heat) may be successfully used to dry the hydraulically entangled composite fabric.

It may be desirable to use finishing steps and/or post treatment processes to impart selected properties to the composite fabric 36. For example, the fabric may be lightly or heavily pressed by calender rolls, creped or brushed to provide a uniform exterior appearance and/or certain tactile properties. Alternatively and/or additionally, chemical post-treatments such as, adhesives or dyes may be added to the fabric. It is contemplated that the composite fabric may be saturated or impregnated with latexes, emulsions and/or bonding agents. For example, the composite fabric may be treated with a heat activated bonding agent.

In one aspect of the invention, the fabric may contain various materials such as, for example, activated charcoal, clays, starches, and superabsorbent materials. For example, these materials may be added to the suspension of fibrous material used to form the layer of fibrous material. These materials may also be deposited directly on the matrix of thermoplastic, substantially continuous filaments or on the layer of fibrous material prior to the fluid jet treatments so that they become incorporated into the composite fabric by the action of the fluid jets. Alternatively and/or additionally, these materials may be added to the composite fabric after the fluid jet treatments. If superabsorbent materials are added to the suspension of fibrous material or to the layer of fibrous material before water-jet treatments, it is preferred that the superabsorbents are those which can remain inactive during the wet-forming and/or water-jet treatment steps and can be activated later. Conventional superabsorbents may be added to the composite fabric after the water-jet treatments.

The hydraulically entangled, autogenous-bonding, non-woven composite fabric is adapted to autogenously bonded to itself by application of heat. This is particularly advantageous where heat-sealed packaging is desired. For example, many types of infusion packaging is heat-sealed. Exemplary heat-sealed infusion packages include tea bags and coffee filter packs.

Figure 2:
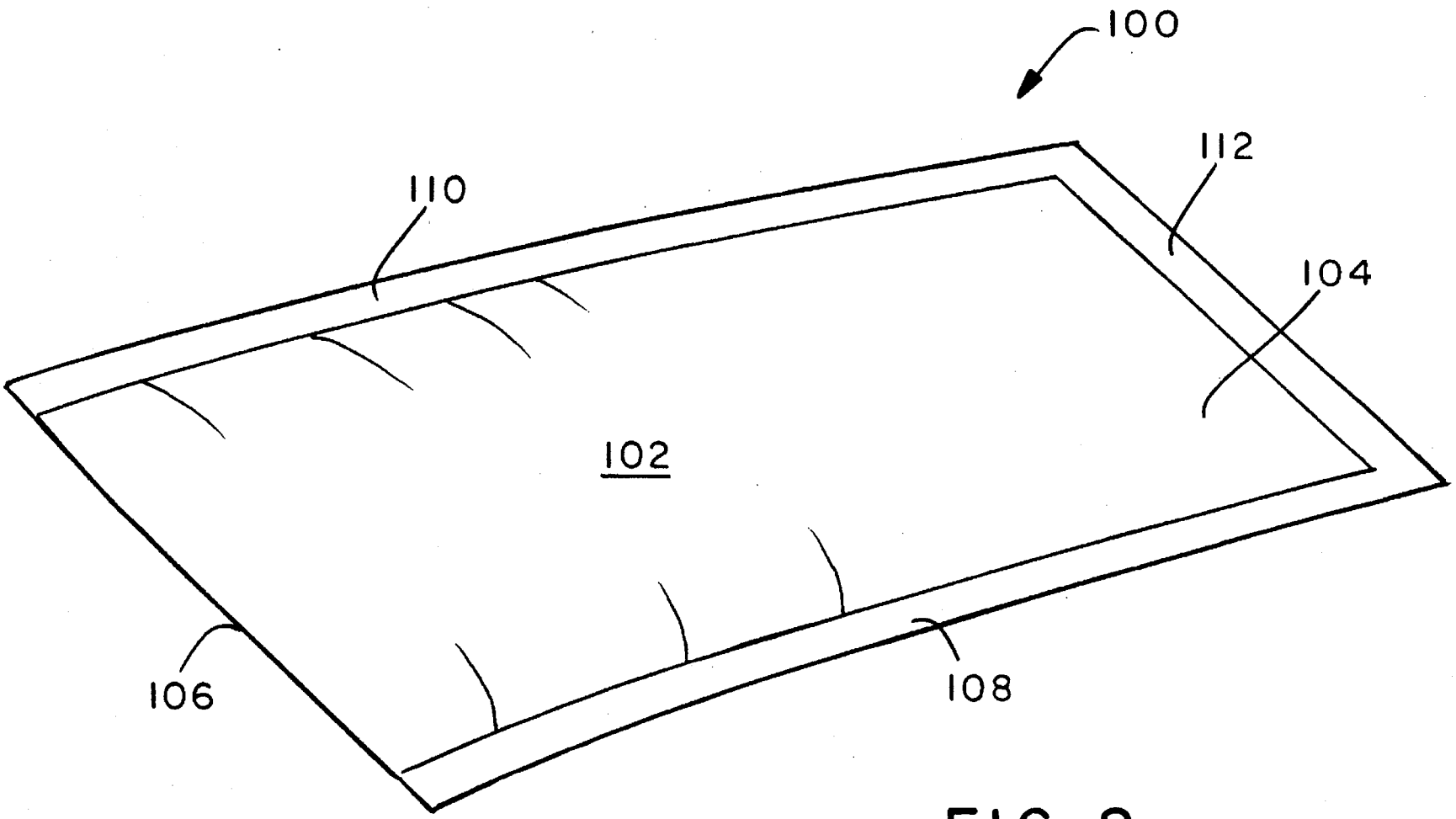
FIG. 2 is a representation of an exemplary infusion package.

An exemplary heat-sealed infusion package is illustrated in FIG. 2 at 100. The infusion package 102 is composed of a strip of infusion package material 104 which has a folded end 106. Extending from the folded end 106 is a first seam 108 and a second seam 110. At the portion of the infusion package 102 opposite the folded end 106 is an end seam 112. A material (e.g., tea, coffee, desiccants) sandwiched between the folded strips of infusion package material is secured by the seams.

EXAMPLES

Tensile strength and elongation measurements of samples were made utilizing an Instron Model 1122 Universal Test Instrument in accordance with Method 5100 of Federal Test Method Standard No. 191A. Tensile strength refers to the maximum load or force (i.e., peak load) encountered while elongating the sample to break. Measurements of peak load were made in the machine and cross-machine directions for both wet and dry samples. The results are expressed in units of force ($grams_f$) for samples that measured 4 inches wide by 6 inches long.

The "elongation" or "percent elongation" of the samples refers to a ratio determined by measuring the difference between a sample's initial unextended length and its extended length in a particular dimension and dividing that difference by the sample's initial unextended length in that same dimension. This value is multiplied by 100 percent when elongation is expressed as a percent. The elongation was measured when the sample was stretched to about its breaking point.

Trapezoidal tear strengths of samples were measured in accordance with ASTM Standard Test D 1117-14 except that the tearing load is calculated as an average of the first and the highest peak loads rather than an average of the lowest and highest peak loads.

The basis weights of samples were determined essentially in accordance with ASTM D-3776-9 with the following changes: 1) sample size was 4 inches×4 inches square; and 2) a total of 9 samples were weighed.

Abrasion resistance testing was conducted on a Rotary Platform, Double-Head (RPDH) Abraser: Taber Abraser No. 5130, with Model No. E 140-14 specimen holder, available from Teledyne Taber, North Tonawanda, N.Y. The abrasive wheel was a nonresilient, vitrified, Calibrade grinding wheel No. h-18, medium grade/medium bond, also available from Teledyne Taber. The test was run without counterweights. Samples measured approximately 5 inches×5 inches (12.7 cm×12.7 cm). Testing was conducted generally in accordance with Method 5306, Federal Test Methods Standard No. 191A. Abrasion resistance was tested on the sample side which appeared to have the greater amount of fibrous material.

Thickness of the samples was determined utilizing a Starrett Thickness Tester Model No. 1085 available from a distributor, J. J. Stangel Co., Manitowoc, Wis. The thickness measurements were made on 4 inch×4 inch specimens using a 3-inch diameter circular foot at an applied loading pressure of about 0.05 pounds per square inch (psi).

Permeability of samples was determined utilizing a Frazier Air Permeability Tester available from the Frazier Precision Instrument Company and measured in accordance with Federal Test Method 5450, Standard No. 191A, except that the sample size was 8"×8" instead of 7"×7". Permeability may be expressed in units of volume per unit time per unit area, for example, (cubic feet per minute) per square foot of material (e.g., ($ft^3$/minute)/$ft^2$ or (CFM/$ft^2$)).

Infusion properties of an infusion package were determined from transmittance measurements of a liquid. In a typical test, infusion package material was cut into two 2.75 inch×5 inch strips. Each strip was folded in half so that the surfaces most advantageous to autogenous bonding faced each other (i.e., the surfaces appearing to have the most exposed substantially continuous, thermoplastic polymer filaments). Two sides of each folded strip were heat sealed along each edge at a seal width of about ¼ inch to form a package. The sealing may be performed with a Sentinel heat sealer Model Number 12AS, manufactured by Packaging Industries, Montclair, N.J. The heat sealer was preset to 350° F. and the dwell time of the heated bar was about 0.4 seconds. About 2.3 grams of tea was placed in each infusion package and the open ends of each bag were sealed as described above. Each infusion package was placed in a separate 400 ml beaker. Approximately 250 ml of boiling distilled water was poured over each bag and a stopwatch was started. Tea was allowed to infuse for four minutes. Each infusion package was lifted from the beaker with a spoon and the bags were allowed to drip into their respective beakers for about 10 seconds. Transmittance was measured for each sample by placing the infused liquid in a Pyrex 9800 test tube (13 mm outside diameter×100 mm length). The test tube was inserted in a Bausch & Lomb Spectronic 20 Colorimeter. The Colorimeter was preset to a 550 micron wavelength and the percent transmittance was set at 100. The measured percent transmittance was recorded. Generally speaking, percent transmittance measurements made using this test on commercially available infusion package materials average about 59 percent. Exemplary commercially available infusion package materials generating such results include, for example, TETLEY® Iced Tea Bags and a heat seal infusion package material available under the trade designation Grade 533 BHS from Kimberly-Clark Corporation, Roswell, Ga.

Bond strength measurements of a heat-sealed, autogenously bonded samples generally conformed to ASTM Standard Test D 2724.13 and to Method 5951, Federal Test Methods Standard No. 191 A. Specimen size is about 1 inch by 7 inches (7 inches in the machine direction), gauge length was set at about one inch; and 3) the value of the peak load alone is interpreted as the bond strength of the specimen. The bond strength of the sample unit is calculated as the average peak load of all the specimens tested. According to the test procedure, each test specimen is composed of a 1 inch by 7 inch strip which has been folded in half and autogenously bonded by the application of heat, beginning in the center of the sample at the fold and extending a distance of about one inch away from the fold along the center of the sample. The surfaces facing each other after the fold were the surfaces appearing most suitable for autogenous bonding (i.e., had the most exposure of substantially continuous, thermoplastic polymer filaments). Each unbonded or free end (i.e., the two ends opposite the fold) is clamped into a jaw of a testing machine and the maximum force (i.e., peak load) needed to completely separate the laminate is measured. The layers are pulled apart at a 180 degree angle. The test equipment jaw travel rate is set at 50 millimeters per minute. The results of testing (i.e., the adhesion strength) are reported in units of force per unit(s) of width. For example, the adhesion strength can be reported in units of $grams_{force}$ per centimeter (or centimeters) of width; $grams_{force}$ per inch (or inches) of width; or other suitable units.

In-plane tear propagation testing measured the energy required to propagate a tear across a given width of a specimen (e.g., a paper sheet) by forces acting in the plane of the specimen. Specimens were cut to a width of one inch and a length of seven inches (seven inches in the machine direction). The ends were clamped in an Instron Model 1122 test instrument. The jaws were set so they clamped the specimen at an angle of about 5 degrees to create a slack edge. The crosshead speed was set at 10 millimeters per minute. A small slit was made opposite the slack edge of the specimen at a location about equally distant from each jaw. The absolute in-plane tear energy is reported in units of force.length (e.g., $grams_{force}$ . centimeters)

Example I

Approximately 1.32 grams of Northern softwood bleached pulp were formed into a sheet in a 12"×12" paper-maker's mold. The sheet was dried in a conventional paper-making manner. The sheet was rehydrated and transferred onto a spunbonded web made of polypropylene having a basis weight of 0.4 oz/$yd^2$ (approximately 14 gsm). The web of polypropylene spunbond filaments was formed as described, for example, in previously referenced U.S. Pat. Nos. 4,340,563 and 3,692,618. The spunbond filaments were bonded utilizing a pattern having a pin density of about 306 pins per square inch. Each pin defines square bond surface having sides which are about 0.025 inch in length. When the pins contact a smooth anvil roller they create a total bond surface area of about 15.7 percent.

The laminate, having a total basis weight of about 27.5 gsm, was hydraulically entangled into a composite material utilizing 1 manifold. The manifold was equipped with a jet strip having one row of 0.005 inch holes at a density of 40 holes per inch. Water pressure in the manifold was about 220 psi (gage) and the laminate was entangled in three passes. The layers were supported on a conventional mesh stainless steel forming/entangling wire. The composite fabric was dried on a hot plate set at a temperature of about 170° Fahrenheit. After drying, the composite fabric was calendered utilizing two smooth rubber calender rolls. The pressure at the nip was about 150 psi.

Various physical properties were measured and are reported in Table 1 as P3364-64-1.

Example II

A blend of 0.35 grams of cotton linters and 1.05 grams of Northern softwood bleached pulp was formed into a sheet and dried in conventional paper-making manner. The sheet was rehydrated and transferred to a 14 gsm spunbonded web. The spunbond web was bonded with the pattern described in Example I. The laminate was hydraulically entangled, dried and calendered using the procedure set forth in Example 1. The properties for this sheet are found in Table I, represented by sample P3364-64-4.

Several commercially available heat sealable products used in infusion packaging were tested for Tensile strength (wet and dry) and permeability. These and other physical attributes of the commercially available materials are reported in Table 1.

Example III

A slurry of approximately 14.5 pounds of Northern softwood bleached pulp was deposited into a 22-inch wide, continuous sheet maker to produce a sheet of pulp fibers that would have a basis weight of about 14 to 15 gsm when dried. The wet sheet was hydroentangled with a 0.4 oz/yd$^2$ (approximately 14 gsm) spunbonded web to form a laminate structure with the spunbonded web on the bottom. The spunbond web was bonded with the pattern described in Example I. The sheet was passed at 50 ft/min under water jets from a series of three manifolds, each of which having a single row of 0.007-inch diameter orifices spaced 30 per inch the full width of the web. All three manifolds were operated at a pressure of 500 psig. The composite fabric was dried utilizing conventional through-air drying equipment. Various physical properties of the sheet were measured and are reported in Table 2. The web has a high wet tensile strength and meets infusion and heat sealing requirements for infusion packages used with tea and coffee.

Example IV

A layer of Northern softwood pulp fibers (approximately 15 gsm) was wet-formed and then transferred onto a 0.4 ounce per square yard (osy) (14 gsm) web of polypropylene spunbond filaments (formed as described, for example, in previously referenced U.S. Pat. Nos. 4,340,563 and 3,692,618). The spunbond web was bonded with the pattern described in Example I. The laminate, having a total basis weight of about 29 gsm, was hydraulically entangled into a composite material utilizing 4 manifolds. Each manifold was equipped with a jet strip having one row of 0.006 inch holes at a density of 30 holes per inch. Water pressure in the manifold was 650 psi (gage). The layers were supported on a 100 mesh stainless steel forming wire which travelled under the manifolds at a rate of about 350 fpm. The composite fabric was dried utilizing conventional through-air drying equipment. Various physical properties of the sheet were measured and are reported in Table 2.

Example V

A hydraulically entangled, autogenous-bonding, nonwoven composite fabric was prepared using the same materials and procedure set forth in Example IV. The composite fabric had a basis weight of about 30 gsm. A sample of the fabric was calendered utilizing two smooth rubber calender rolls. The pressure at the nip was about 150 psi. Samples of calendered and uncalendered materials were folded, heat sealed and placed in boiling water for five minutes. No delamination occurred for either the calendered or uncalendered samples. Various physical properties and performance characteristics of the sheets were measured and are reported in Table 3.

Example VI

The hydraulically entangled, autogenous-bonding, nonwoven composite fabrics of Examples III and IV were cut into specimens of about 1 inch by 7 inches (7 inches in the machine direction). The specimens were folded in half and autogenously bonded beginning in the center of the sample at the fold and extending a distance of about one inch along the center of the sample. The surfaces facing each other after the fold were the surfaces appearing most suitable for autogenous bonding (i.e., had the most exposure of substantially continuous, thermoplastic polymer filaments). The samples were ultrasonically bonded utilizing a Sonobond Model LM920 bonder available from Sonobond Ultrasonics, West Chester, Pa. The bonder speed was set at 1 and the bonder output was set at 5. Bonding was achieved with a discontinuous double-line bond pattern wheel having an overall width of about one centimeter. Strength of the autogenous bond was tested in accordance with ASTM Standard Test D 2724.13 and to Method 5951, Federal Test Methods Standard No. 191 A as described above.

The mean bond strength for the material of Example III (based on three specimens) was 762 grams per inch of width (standard deviation was 228). The mean bond strength for the material of Example IV (based on three specimens) was 560 grams per inch of width (standard deviation was 109).

Example VII

A hydraulically entangled, autogenous-bonding, nonwoven composite fabrics was prepared following the procedure of Example III except that the matrix of substantially continuous, thermoplastic polymer filaments was a spunbonded bi-component filament web. The bi-component filaments in the web had a side-by-side configuration and contained a polyethylene component and a polypropylene component. Spunbonded bi-component filament webs of this type may be available from Kimberly-Clark Corporation, Roswell, Ga. The spunbonded bi-component filament web had a basis weight of about 24 gsm and was hydraulically entangled with an approximately 24 gsm layer Northern softwood bleached pulp. The composite fabric was dried utilizing a conventional through-air dryer.

The composite fabric was tested for autogenous bond strength according to the procedure of Example VI except that the samples were bonded utilizing a Sentinel heat sealer Model Number 12AS, manufactured by Packaging Industries, Montclair, N.J. The bonder was set for a dwell time of 0.3 seconds and the bar pressure 50 pound per square inch (gage). Specimens were bonded at temperature settings of 460° Fahrenheit, 530° Fahrenheit and 560° Fahrenheit. Bonding was achieved with a one inch wide seal bar. Samples were heated from one side. Strength of the autogenous bond was tested in accordance with ASTM Standard Test D 2724.13 and to Method 5951, Federal Test Methods Standard No. 191 A as described above.

Bond strength measured for the material sealed at 460° Fahrenheit was 541 grams per inch of width. Bond strength measured for the material sealed at 530° Fahrenheit was 752 grams per inch of width. Bond strength measured for the material sealed at 560° Fahrenheit was 871 grams per inch of width.

Comparative Examples

Tables 1 and 2 contain data reporting various physical property measurements of commercially available infusion package material. Package material was removed from a TETLEY® Iced Tea Bag and a MAXWELL HOUSE® Coffee Filter Pack. Tables 1 and 2 also contain data for a heat seal infusion package material available from Kimberly-Clark Corporation, Roswell, Ga. This heat seal infusion package material is designated Grade 533 BHS. It is composed of a multi-layer paper containing a layer of base furnish (about 88 percent, by weight) and a layer of seal furnish (about 12 percent, by weight). Since the seal furnish itself was actually composed of about 40 percent, by weight, base furnish material, the true composition of the infusion package material was about 93 percent, by weight, base furnish and about 7 percent, by weight, other material. The multi-layered material was created utilizing different headboxes to deposit each furnish in a conventional papermaking process. Specific ingredients of each furnish are reported in Table 4.

TABLE 1

| General Properties | | HS* P3364-64-1 | HS** P3364-64-4 | Grade 533 BHS | TETLEY ® Iced Tea Bag | MAXWELLHOUSE ® Coffee Filter Pack |
|---|---|---|---|---|---|---|
| Basis Weight | gsm | 27.5 | 27.0 | 26.0 | 25.8 | 22.5 |
| Thickness | mils | 4.0 | 4.0 | 4.6 | 4.3 | 3.3 |
| Tensile | | | | | | |
| dry-MD | g/in. | 1700 | 1350 | 2900 | 1600 | 2200 |
| dry-CD | g/in. | — | — | 1169 | — | — |
| wet-MD | g/in. | 880 | 830 | 890 | 600 | 900 |
| wet-CD | g/in. | — | — | 330 | — | — |
| In-Plane Tear | gcm | 1726 | 1805 | 170 | 78 | 126 |
| Permeability | $ft^3$/min. $ft^2$ | 275.7 | 277 | 210 | 139 | 118 |

*See Example I
**See Example II

TABLE 2

| Physical Properties | Units | Example III | Example IV | Grade BHS 533 |
|---|---|---|---|---|
| Basis Weight | (gsm) | 29.5 | 29.0 | 25.0 |
| Thickness | (mils) | 6.6 | 6.7 | 6.6 |
| Tensile | | | | |
| MD Dry | (g/in) | 1825 | 1969 | 3470 |
| MD Wet | (g/in) | 1402 | 1525 | 1350 |
| CD Dry | (g/in) | 848 | 405 | 1400 |
| CD Wet | (g/in) | 510 | 335 | 500 |
| Elongation | | | | |
| MD | (%) | 50.2 | 51.5 | — |
| CD | (%) | 87.1 | 88.0 | — |
| Trapezoidal Tear | | | | |
| MD | (g) | 2127 | 1931 | 185 |
| CD | (g) | 1181 | 1167 | 179 |
| Permeability | (CFM/sq. ft) | 323 | 367 | 200 |
| Abrasion Resistance | (cycles) | 8 | 8 | — |

TABLE 3

| Physical Properties | | Example V Uncal. | Example V Cal. |
|---|---|---|---|
| Basis Weight | gsm | 30 | 30 |
| Thickness | mils | 7.4 | 4.9 |
| Tensile | | | |
| Dry MD | g/in | 2067 | 1825 |
| Dry CD | g/in | 830 | 848 |
| Wet MD | g/in | 1981 | 1902 |
| Wet CD | g/in | 625 | 510 |
| Permeability | CFM | 337 | 303 |
| Infusion Transmittance | % | 58.2 | 58.7 |

TABLE 4

Composition of Grade BHS 533 approximately 88%, by weight Base Furnish and 12%, by weight, Seal Furnish

| Base Furnish (percent, by weight) | | Seal Furnish (percent, by weight) | |
|---|---|---|---|
| Northern Softwood Pulp (bleached) | 16% | Vinyl Acetate Fiber | 30% |
| Abaca Ecuador Pulp | 68% | Polyethylene Fiber | 30% |
| Rayon Fiber | 15% | Base Furnish | 40% |

TABLE 4-continued

Composition of Grade BHS 533 approximately 88%, by weight Base Furnish and 12%, by weight, Seal Furnish

| Base Furnish (percent, by weight) | | Seal Furnish (percent, by weight) |
|---|---|---|
| 5.5 denier 12 mm length | | Material |
| Guar Gum | 1% | |

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A hydraulically entangled, autogenous-bonding, nonwoven composite fabric comprising:

a matrix of substantially continuous thermoplastic polymer filaments; and at least one substantially non-thermoplastic fibrous material integrated in the matrix, wherein the composite fabric is adapted to autogenously bond to itself upon application of heat.

2. The nonwoven composite fabric of claim 1, wherein the matrix of substantially continuous thermoplastic polymer filaments is a nonwoven web of spunbonded filaments.

3. The nonwoven composite fabric of claim 1, wherein the matrix of substantially continuous thermoplastic polymer filaments is composed of thermoplastic polymers selected from polyolefins, polyamides, polyesters, polyurethanes, A-B and A-B-A' block copolymers where A and A' are thermoplastic endblocks and B is an elastomeric midblock, copolymers of ethylene and at least one vinyl monomer, unsaturated aliphatic monocarboxylic acids, and esters of such monocarboxylic acids.

4. The nonwoven composite fabric of claim 3, wherein the polyolefin is selected from polyethylene, polypropylene, polybutene, ethylene copolymers, propylene copolymers, butene copolymers and/or blends of the above.

5. The nonwoven composite fabric of claim 2, wherein the nonwoven web of spunbonded filaments is a nonwoven web of bi-component spunbonded filaments.

6. The nonwoven composite fabric of claim 5, wherein the nonwoven web of continuous bi-component spunbonded filaments is composed of thermoplastic polymers selected from polyolefins, polyamides, polyesters and polyurethanes.

7. The nonwoven composite fabric of claim 1, wherein the substantially non-thermoplastic fibrous material is selected from pulp fibers, cotton linters, flax, natural fibers, synthetic fibers, and mixtures of the same.

8. The nonwoven composite fabric of claim 7, wherein the pulp fibers are selected from the group consisting of hardwood pulp fibers, softwood pulp fiber, and mixtures of the same.

9. The nonwoven composite fabric of claim 7, wherein the fibrous material has an average length of from about 0.7 to about 20 millimeters.

10. The nonwoven composite fabric of claim 1, wherein the fabric has a basis weight of from about 15 to about 300 grams per square meter.

11. A multilayer material comprising at least one layer of the nonwoven composite fabric according to claim 1 and at least one other layer.

12. The multilayer material of claim 11 wherein the other layer is selected from the group consisting of films, papers, woven fabrics, knit fabrics, bonded carded webs, continuous filament webs, meltblown fiber webs, and combinations thereof.

13. An infusion package comprising one or more layers of the nonwoven composite fabric of claim 1, the fabric having a basis weight from about 15 gsm to about 60 gsm.

14. A hydraulically entangled, autogenous-bonding, nonwoven composite fabric comprising:

from about 10 to about 90 percent, by weight, of a matrix of substantially continuous, thermoplastic polymer filaments; and from about 90 to about 10 percent, by weight, of at least one substantially non-thermoplastic fibrous material integrated in the matrix, wherein the composite fabric is adapted to autogenously bond to itself upon application of heat.

15. The nonwoven composite fabric of claim 14 comprising from about 25 to about 75 percent, by weight, thermoplastic polymer filaments and from about 75 to about 25 percent, by weight, fibrous material.

16. The nonwoven composite fabric of claim 14, wherein the fabric is adapted to autogenously bond to itself at a bond strength greater than about 400 grams per inch of width.

17. The nonwoven composite fabric of claim 16, wherein the fabric is adapted to autogenously bond to itself at a bond strength of from about 500 to about 1000 grams per inch of width.

18. A hydraulically entangled, autogenous-bonding, nonwoven infusion package material comprising:

from about 25 to about 75 percent, by weight, of a matrix of substantially continuous, thermoplastic polymer filaments; and from about 75 to about 25 percent, by weight, of at least one substantially non-thermoplastic fibrous material integrated in the matrix, wherein the infusion package material is adapted to autogenously bond to itself upon application of heat.

19. A method of making a hydraulically entangled, autogenous-bonding, nonwoven composite fabric comprising the steps of:

superposing a layer of at least one substantially non-thermoplastic fibrous material over a matrix of substantially continuous, thermoplastic polymer filaments, integrating the fibrous material into the matrix by hydraulic entangling to form a composite fabric, and drying the composite fabric, wherein the composite fabric is adapted to autogenously bond to itself upon application of heat.

20. The method of claim 19 wherein the layer of fibrous material is superposed over the matrix of substantially continuous, thermoplastic polymer filaments by depositing the fibrous material onto the matrix of substantially continuous filaments utilizing dry forming and wet-forming techniques.

21. The method of claim 20 wherein the layer of fibrous material is superposed over the matrix of substantially continuous, thermoplastic polymer filaments by superposing a coherent sheet of pulp fibers on a layer of continuous filaments.

22. The method of claim 21 wherein the layer of fibrous material is selected from re-pulpable paper sheets, re-pulpable tissue sheets, and batts of wood pulp fibers.

* * * * *